US006948203B2

(12) United States Patent
Tsai

(10) Patent No.: US 6,948,203 B2
(45) Date of Patent: Sep. 27, 2005

(54) BACKPACK CONVERTIBLE TO A STRETCHER

(76) Inventor: Chiang-Han Tsai, No. 16, Alley 39, Lan 151, Sec. 2, Ho-Shun Road, Kuei-Jen Hsiang, Tainan Hsein (TW)

( * ) Notice: Subject to any disclaimer, the term of this patent is extended or adjusted under 35 U.S.C. 154(b) by 0 days.

(21) Appl. No.: 10/865,168

(22) Filed: Jun. 10, 2004

(65) Prior Publication Data

US 2004/0221392 A1 Nov. 11, 2004

(51) Int. Cl.[7] ..... A61G 1/013; A61G 1/007
(52) U.S. Cl. ..... 5/627; 5/626
(58) Field of Search ..... 5/627, 626, 625, 5/628

(56) References Cited

U.S. PATENT DOCUMENTS 4,124,908 A * 11/1978 Burns et al. ..... 5/627
5,502,854 A * 4/1996 Daouk ..... 5/627
6,061,853 A * 5/2000 Laaksonen et al. ..... 5/627
6,216,296 B1 * 4/2001 Carrasco ..... 5/627
6,484,912 B2 * 11/2002 Jones ..... 224/153
6,871,368 B2 * 3/2005 Calkin ..... 5/627

* cited by examiner

*Primary Examiner*—Frederick L. Lagman
(74) *Attorney, Agent, or Firm*—Baker & Daniels

(57) ABSTRACT

A backpack includes an accommodating body, two slings, and a plurality of sliding plates. The accommodating body has a rectangular horizontal bottom wall, a front wall, a rear wall, and two side walls. The front, rear, and side walls extend upwardly from the bottom wall, are interconnected removably to define an accommodating space thereamong, and are removable from one another so as to be coplanar with the bottom wall, thereby forming a stretcher. The slings are fastened to an outer side surface of the front wall. The sliding plates are attached removably to a bottom surface of the stretcher, and contact the ground.

12 Claims, 10 Drawing Sheets

BACKPACK CONVERTIBLE TO A STRETCHER

BACKGROUND OF THE INVENTION

1. Field of the Invention

This invention relates to a backpack, and more particularly to a backpack convertible to a stretcher.

2. Description of the Related Art

Emergency implements are most often brought along on mountain climbing excursions. One such emergency implement is the foldable rigid stretcher, which is typically stored in a backpack for emergency uses. The foldable rigid stretcher is generally used to transport sick or injured persons. However, when stretchers are stored in backpacks, they become bulky and heavy, and therefore difficult to carry while mountaineering.

SUMMARY OF THE INVENTION

The object of this invention is to provide a backpack that is convertible to a stretcher.

According to this invention, a backpack includes an accommodating body, two slings, and a plurality of sliding plates. The accommodating body has a rectangular horizontal bottom wall, a front wall, a rear wall, and two side walls. The front, rear, and side walls extend upwardly from the bottom wall, are interconnected removably to define an accommodating space thereamong, and are removable from one another so as to be coplanar with the bottom wall, thereby forming a stretcher. The slings are fastened to an outer side surface of the front wall. The sliding plates are attached removably to a bottom surface of the stretcher, and contact the ground.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
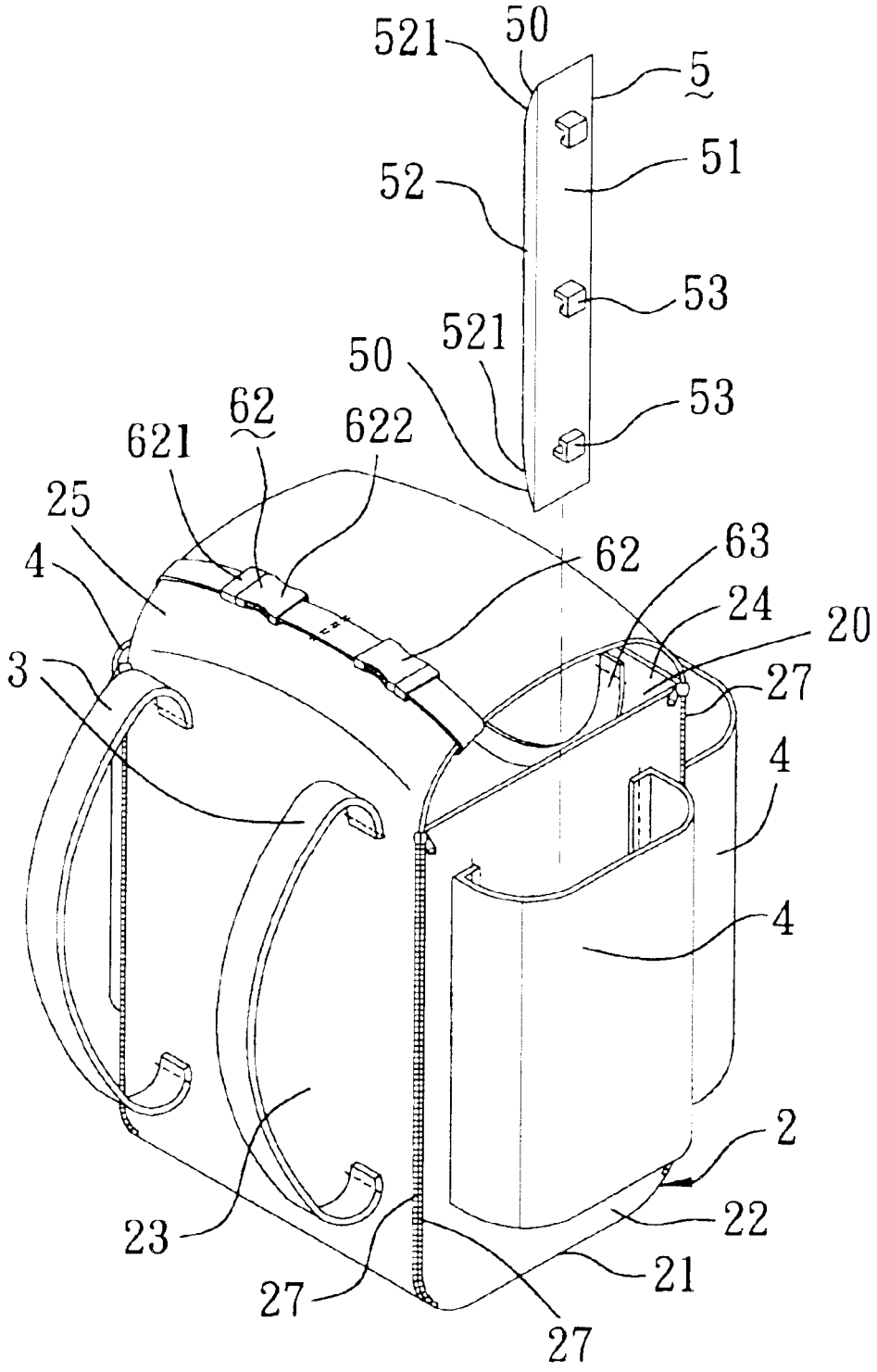
FIG. 1 is a perspective view of the first preferred embodiment of a backpack according to this invention, one sliding plate being removed from one pocket for the purpose of illustrating the structure of the sliding plate.

Before the present invention is described in greater detail in connection with the preferred embodiments, it should be noted that similar elements and structures are designated by like reference numerals throughout the entire disclosure.

Figure 2:
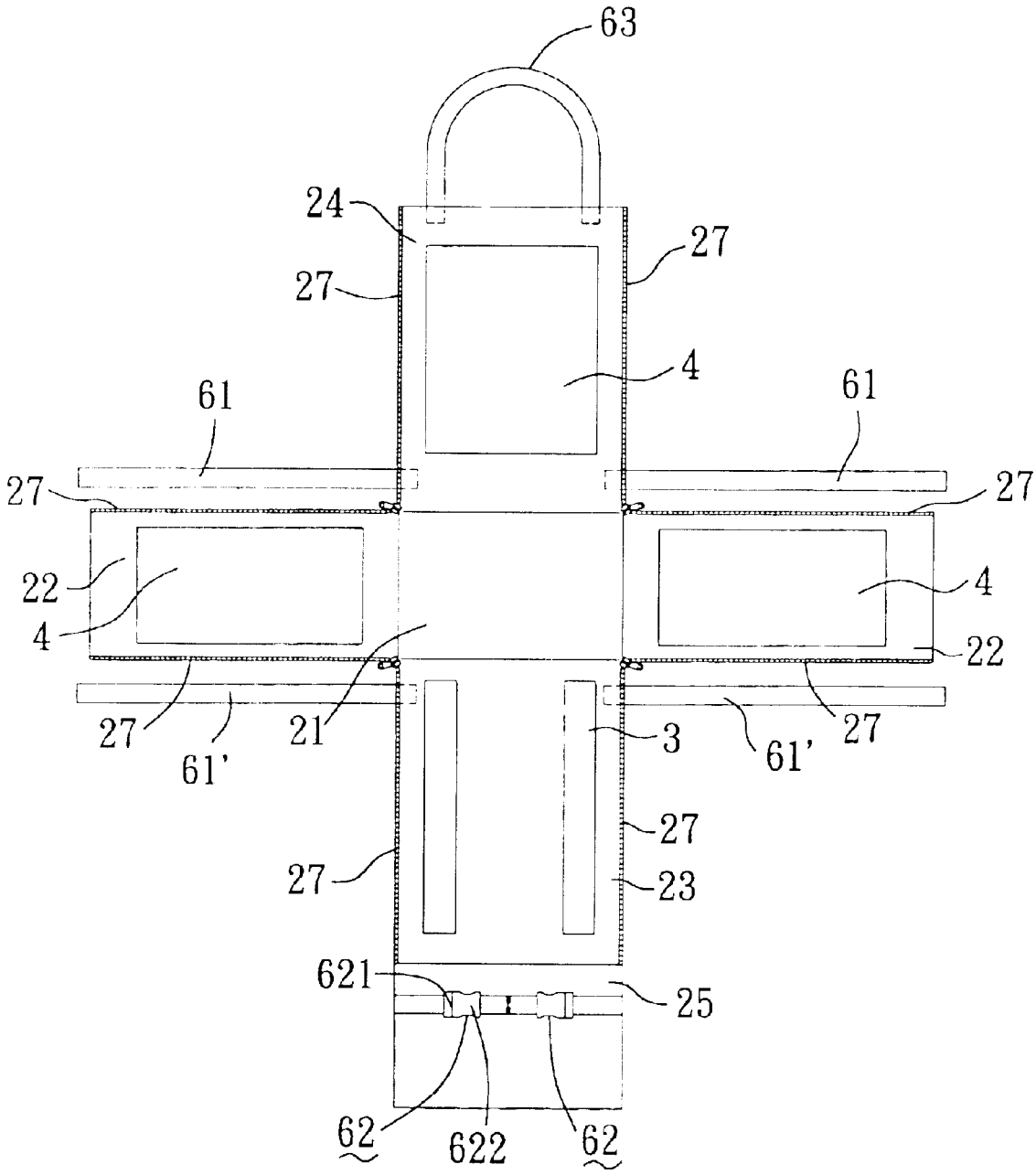
FIG. 2 is a top view of an accommodating body of the first preferred embodiment when it is converted into a stretcher.
Figure 3:
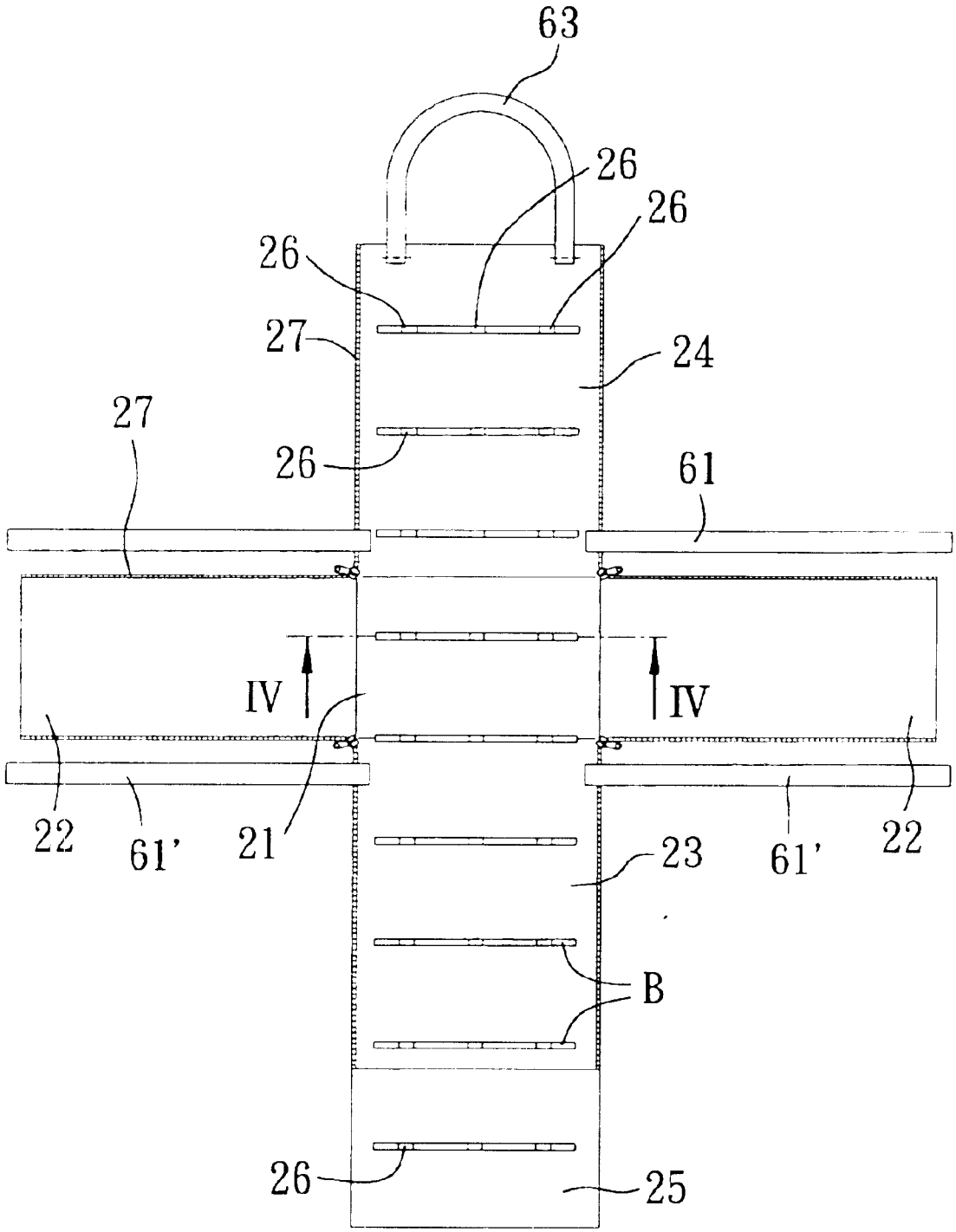
FIG. 3 is a bottom view of the accommodating body of the first preferred embodiment when it is converted into the stretcher.

Referring to FIGS. 1, 2, and 3, the first preferred embodiment of a backpack according to this invention is shown to include an accommodating body 2, two slings 3, three pockets 4, nine sliding plates 5 (see FIG. 5), a pair of breast and arm-retaining bands 61, a pair of waist-retaining bands 61', a pair of shin-retaining bands 62, and a pull band 63.

The accommodating body 2 is made of cloth, such as a waterproof canvas, and has a rectangular horizontal bottom wall 21, two side walls 22 extending respectively and upwardly from left and right sides of the bottom wall 21, front and rear walls 23, 24 extending respectively and upwardly from front and rear sides of the bottom wall 21, and a cover wall 25 extending rearwardly from an upper end of the front wall 23. Each adjacent pair of the side, front, and rear walls 22, 23, 24 is interconnected removably by two zipper elements 27 that are fastened respectively to two adjacent sides thereof. The zipper elements 27 can be replaced with any other suitable elongated connecting elements, such as hook-and-loop fasteners. As such, each of the side, front, and rear walls 22, 23, 24 are connected removably to two adjacent ones of the side, front, and rear walls 22, 23, 24 along two opposite sides thereof so as to define an accommodating space 20 (see FIG. 1) that is disposed among the side, front, and rear walls 22, 23, 24 and that has an upper end opening. The cover wall 25 extends rearwardly from an upper end of the front wall 23 so as to cover the upper end opening of the accommodating space 20, and is connected removably to the rear wall 24 in a known manner. Each of the bottom, side, front, rear, and cover walls 21, 22, 23, 24, 25 has an inner side surface facing the accommodating space 20, and an outer side surface opposite to the inner side surface.

Figure 4:
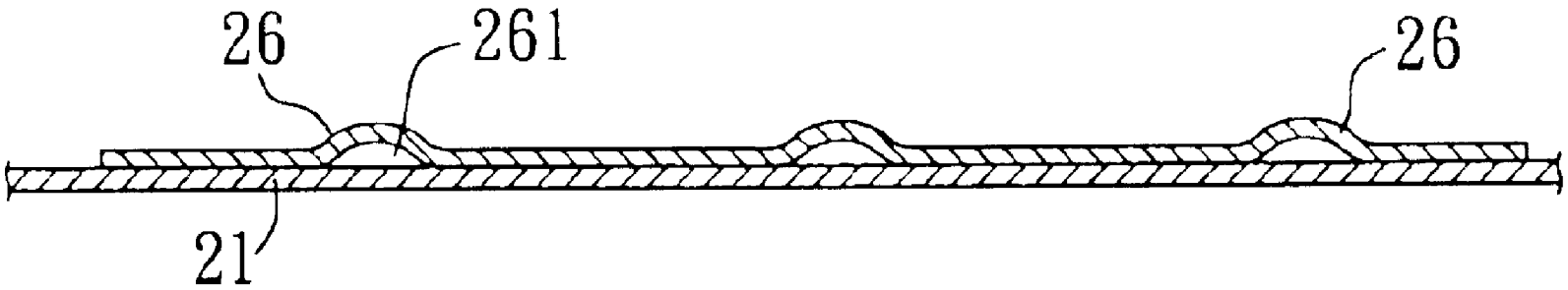
FIG. 4 is a sectional view of the first preferred embodiment taken along Line IV—IV in FIG. 3.

Nine flexible bands (B) are fastened to the inner side surfaces of the front, rear, and cover walls 23, 24, 25. Each of flexible bands (B) is sewn on the front, rear, and cover walls 23, 24, 25 such that three loop members 26 are formed thereon. Each of the loop members 26 defines a hole 261 (see FIG. 4).

The pockets 4 are disposed respectively on the side and rear walls 22, 24. The sliding plates 5 are received within the pockets 4, as shown in FIG. 1.

Each of the sliding plates 5 is rectangular and elongated, and has two tapered ends 50, a planar first side surface 51, a second side surface 52 opposite to the first side surface 51 and having two curved ends 521, and three hooks 53 attached fixedly to the first side surface 51.

Figure 5:
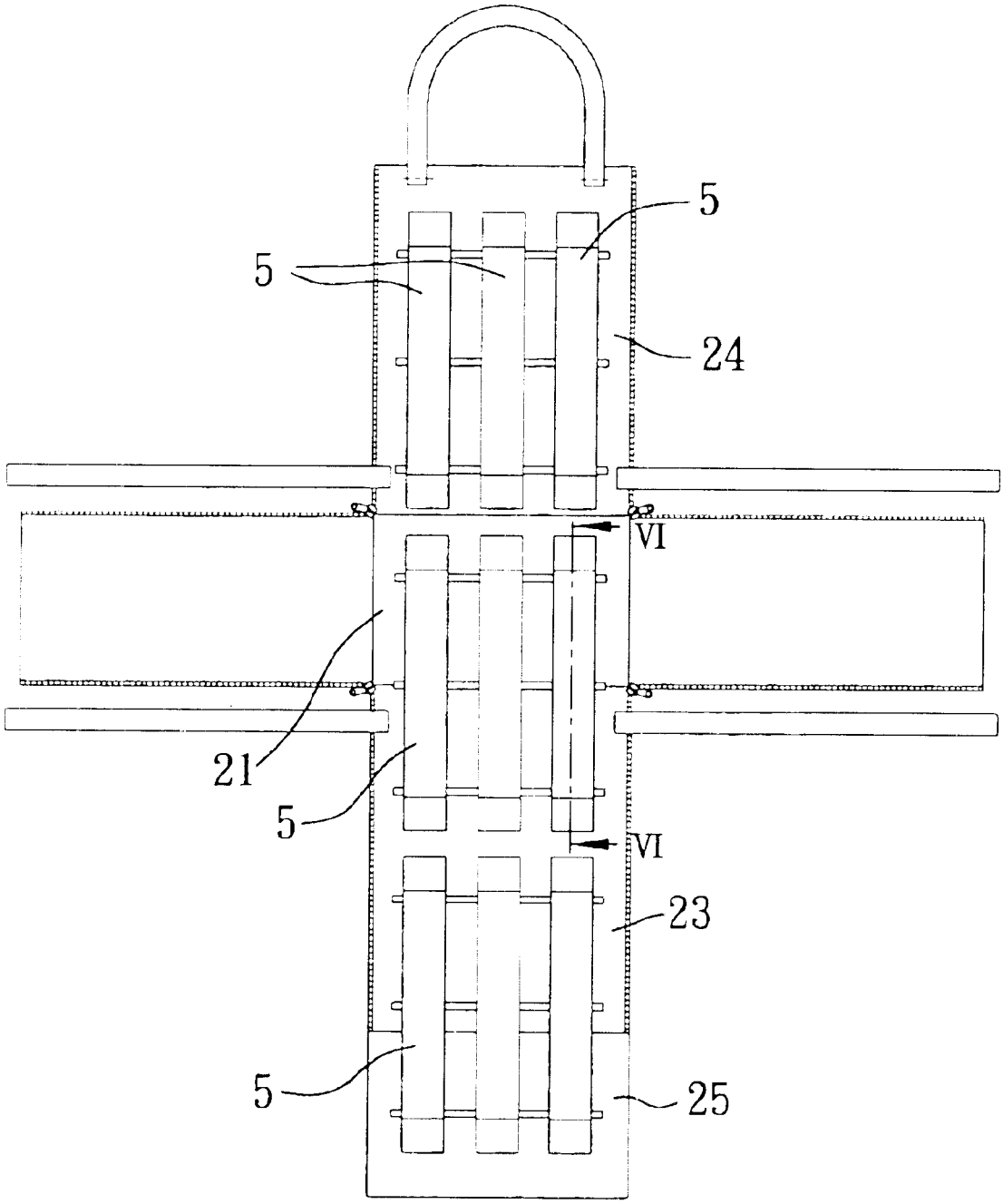
FIG. 5 is a bottom view of the first preferred embodiment, illustrating how a plurality of sliding plates are attached removably to the accommodating body.
Figure 6:
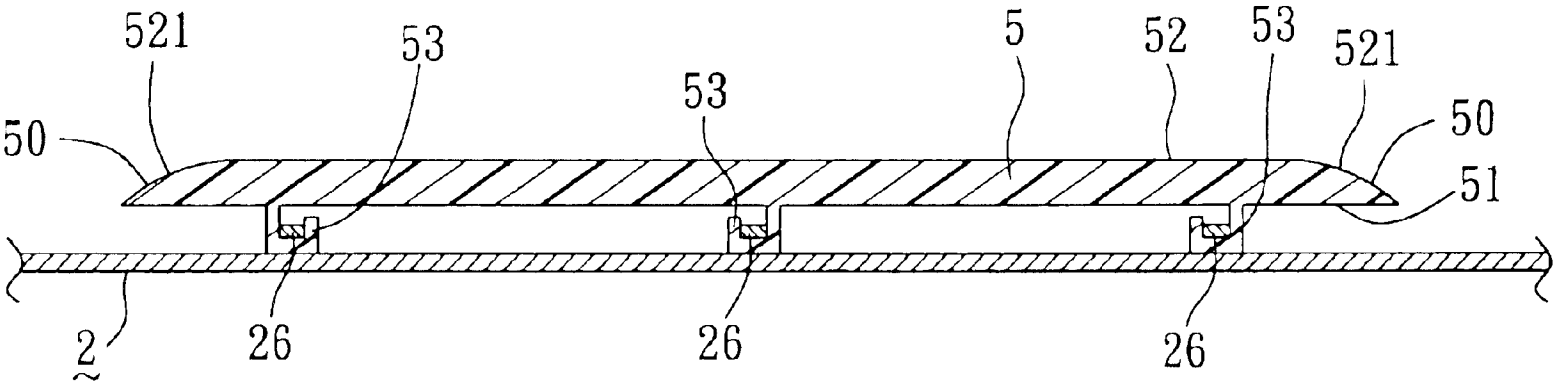
FIG. 6 is a sectional view of the first preferred embodiment taken along Line VI—VI in FIG. 5.
Figure 7:
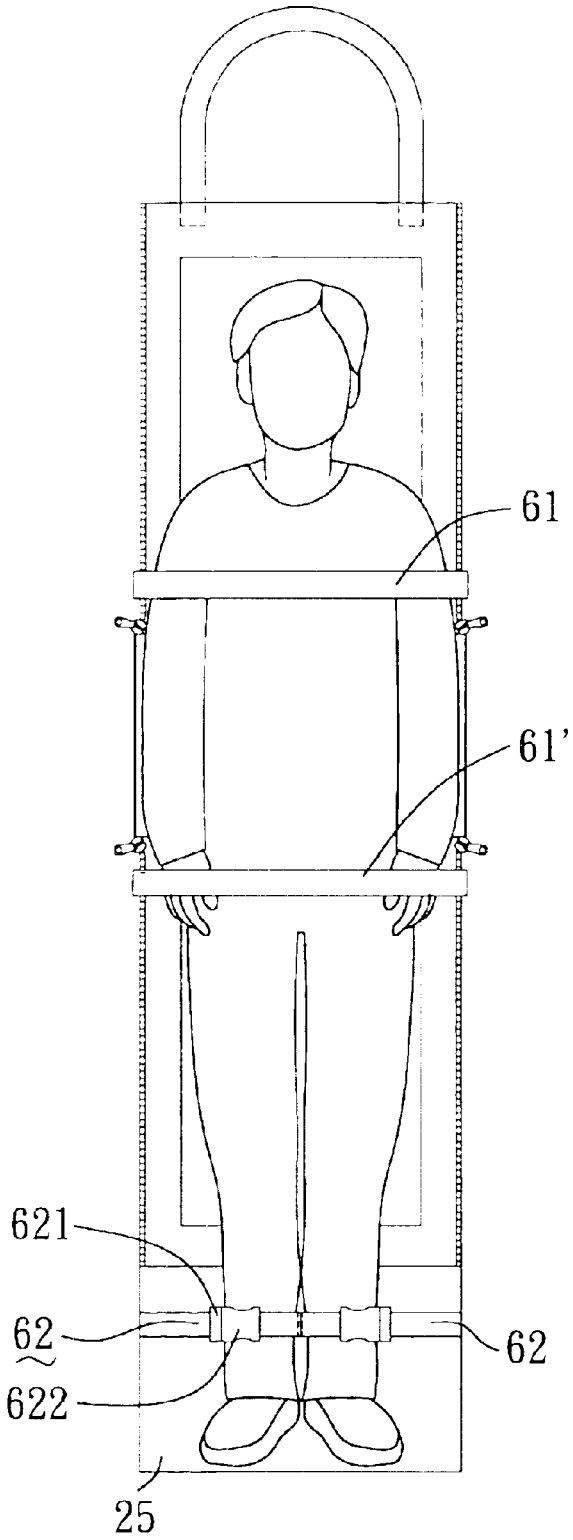
FIG. 7 is a top view of the first preferred embodiment, illustrating how an injured person is fastened to the stretcher.

The accommodating body 2 can be stretched such that the side, front, rear, and cover walls 22, 23, 24, 25 are coplanar with the bottom wall 21 so as to form a stretcher, as shown in FIGS. 2 and 3. When the accommodating body 2 is converted to the stretcher, the outer side surfaces of the bottom, side, front, rear, and cover walls 21, 22, 23, 24, 25 constitute a top surface of the stretcher, as shown in FIG. 2. At the same time, the inner side surfaces of the bottom, side, front, rear, and cover walls 21, 22, 23, 24, 25 constitute a bottom surface of the stretcher, as shown in FIG. 3 so as to permit the hooks 53 of the sliding plates 5 to extend respectively through the loop members 26 of the accommodating body 2, thereby retaining the sliding plates 5 on the accommodating body 2, as shown in FIGS. 5 and 6. As such, the second side surfaces 52 of the sliding plates 5 will contact the ground during use.

The slings 3 are fastened to the outer side surface of the front wall 23 of the accommodating body 2, and are disposed adjacent respectively to left and right sides of the front wall 23.

The breast and arm-retaining bands 61 are fastened respectively to left and right sides of the rear wall 24 of the accommodating body 2, and have free ends that are configured as hook-and-loop fasteners and that are interconnected removably so as to clamp the breast and arms of an injured person between the rear wall 24 and the breast and arm-retaining bands 61.

The waist-retaining bands 61' are fastened respectively to the left and right sides of the front wall 23 of the accommodating body 2, and have free ends that are configured as hook-and-loop fasteners and are interconnected removably so as to clamp the waist and hands of the injured person between the front wall 23 and the waist-retaining bands 61'.

The shin-retaining bands 62 are fastened to the cover wall 25 of the accommodating body 2, and are interconnected removably so as to clamp the shins of the injured person between the cover wall 25 and the shin-retaining bands 62.

Figure 8:
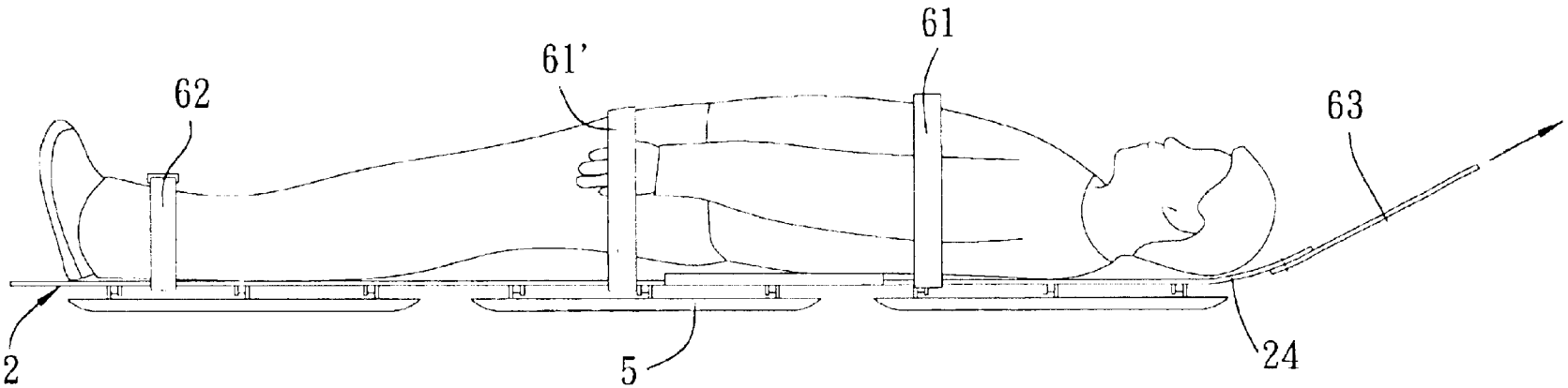
FIG. 8 is a side view of the first preferred embodiment, illustrating how the injured person is fastened to the stretcher.

The pull band 63 is U-shaped, has two ends that are fastened to an upper end of the rear wall 24 of the accommodating body 2, and may be gripped and pulled to move the sliding plates 5 on the ground, as shown in FIG. 8.

Figure 9:
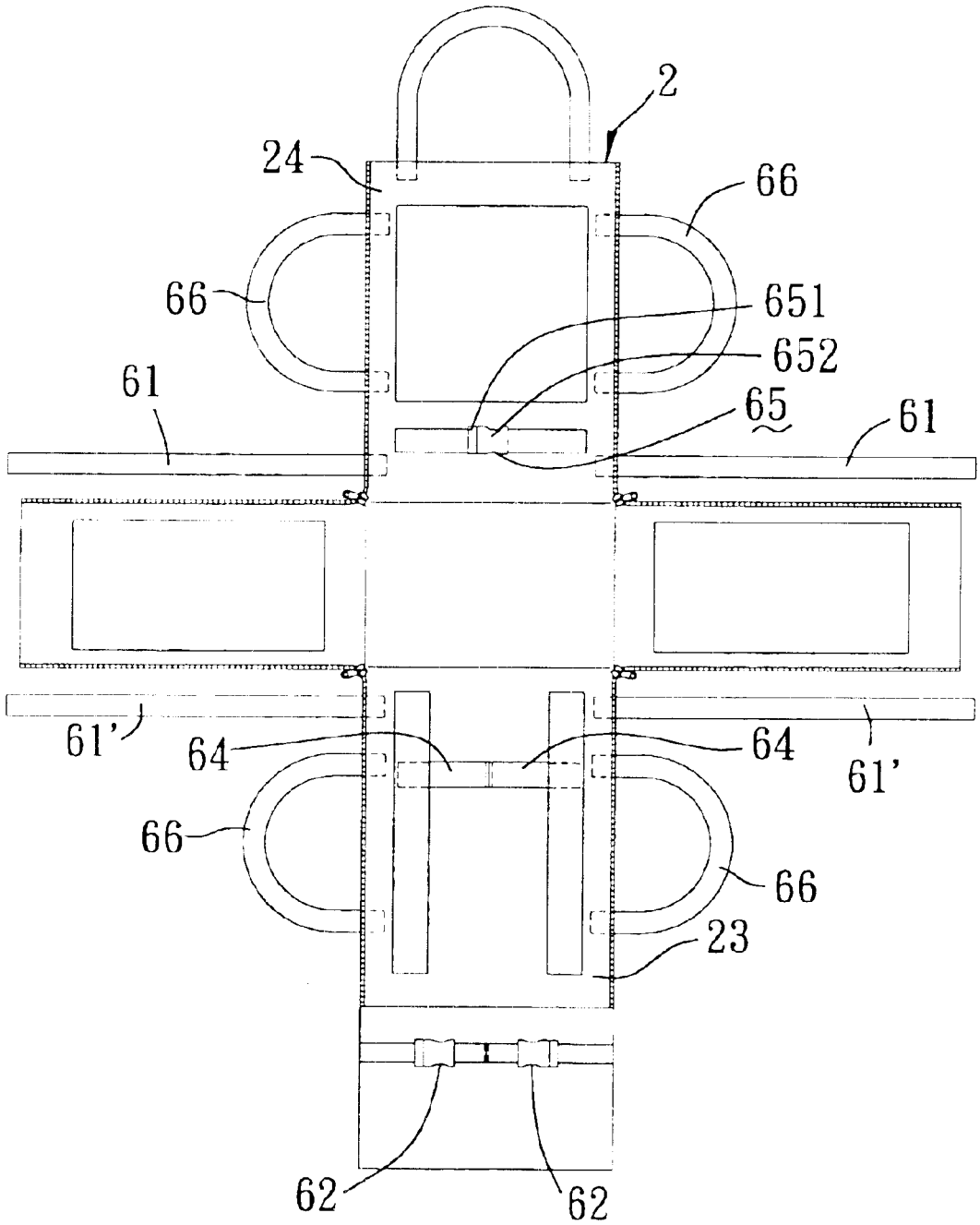
FIG. 9 is a top view of an accommodating body of the second preferred embodiment of a backpack according to this invention when it is converted into a stretcher.
Figure 10:
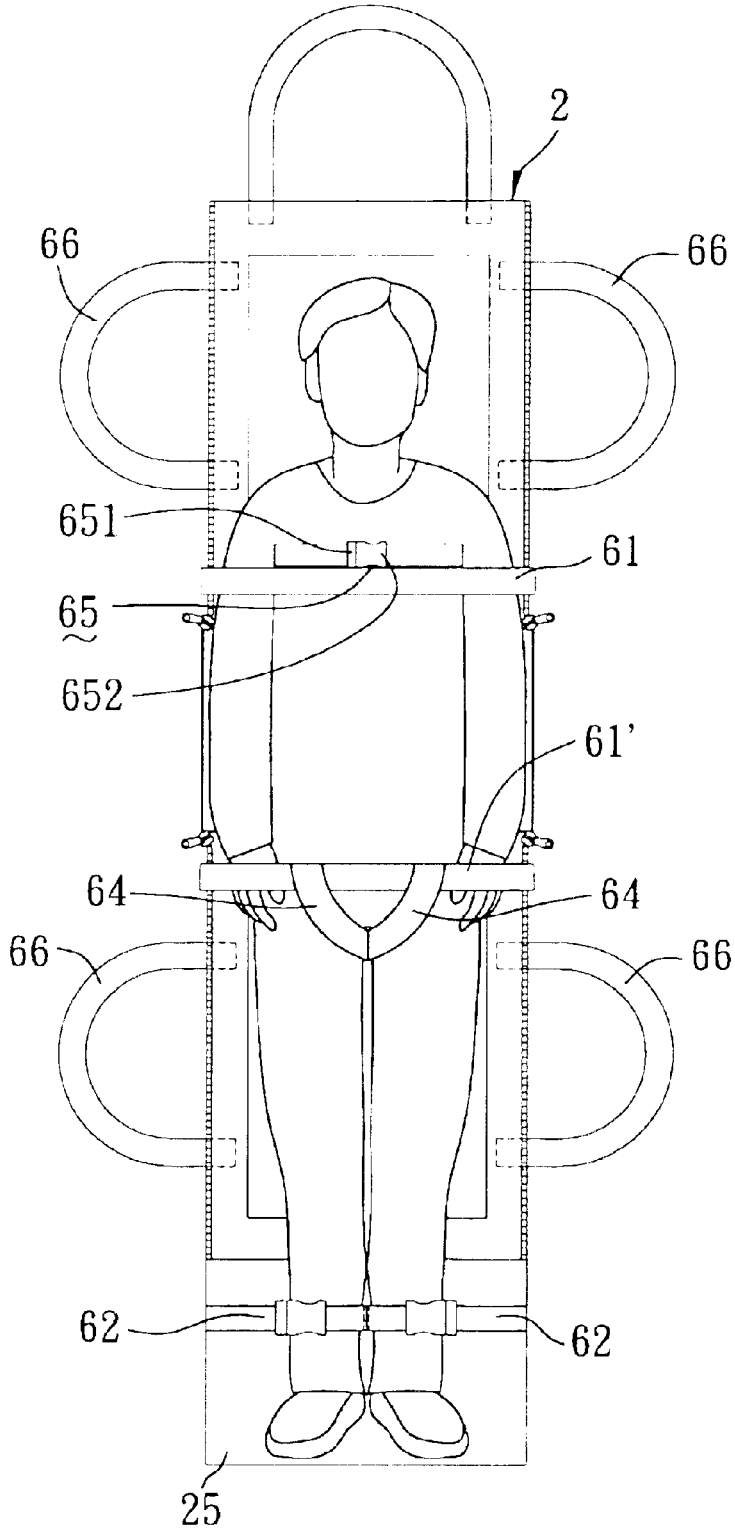
FIG. 10 is a top view of the second preferred embodiment, illustrating how an injured person is fastened to the stretcher.

FIGS. 9 and 10 show the second preferred embodiment of a backpack according to this invention, which is similar to the first preferred embodiment in construction except for the addition of a pair of auxiliary retaining bands 64, a breast-retaining unit 65, and four U-shaped raising bands 66.

The auxiliary retaining bands 64 extend between the thighs of the injured person. Each of the auxiliary retaining bands 64 has a fixed end connected fixedly to the outer side surface of the front wall 23 of the accommodating body 2 and disposed between the thighs of the injured person, and a movable end connected removably to an assembly of the waist-retaining bands 61' by hook-and-loop fasteners.

The breast-retaining unit 65 includes elongated first and second retaining members 651, 652 which are fastened to the outer surface of the rear wall 24 of the accommodating body 2 and which are interconnected removably so as to clamp the breast of the injured person between the rear wall 24 and the first and second retaining members 651, 652.

The raising bands 66 are fastened respectively to the left and right sides of the front and rear walls 23, 24, and may be gripped and pulled upwardly to raise the accommodating body 2 from the ground.

With this invention thus explained, it is apparent that numerous modifications and variations can be made without departing from the scope and spirit of this invention. It is therefore intended that this invention be limited only as indicated by the appended claims.

I claim:

1. A backpack comprising:

an accommodating body having a horizontal bottom wall with front, rear, left, and right sides, two side walls extending respectively and upwardly from said left and right sides of said bottom wall, and front and rear walls extending respectively and upwardly from said front and rear sides of said bottom wall, each of said front, rear, and side walls being connected removably to two adjacent ones of said front, rear, and side walls along two opposite sides thereof so as to define an accommodating space that has an upper end opening, said accommodating body being stretchable such that said front, rear, and side walls are coplanar with said bottom wall so as to form a stretcher, each of said bottom, front, rear, and side walls having an inner side surface facing said accommodating space, and an outer side surface opposite to said inner side surface, each of said front and rear walls having left and right sides;

two spaced-apart slings fastened to said outer side surface of said front wall of said accommodating body and disposed adjacent respectively to said left and right sides of said front wall of said accommodating body; and a plurality of sliding plates attached removably to an assembly of said inner side surfaces of said bottom, front, rear, and side walls of said accommodating body so as to contact the ground when said accommodating body is stretched and when said outer side surfaces of said bottom, front, rear, and side walls of said accommodating body constitute a top surface of said stretcher.

2. The backpack as claimed in claim 1, further comprising at least one pocket disposed on said outer side surface of one of said front, rear, and side walls of said accommodating body.

3. The backpack as claimed in claim 1, further comprising a pull band that is fastened to an upper end of said rear wall of said accommodating body.

4. The backpack as claimed in claim 3, wherein said pull band is U-shaped, and has two ends that are fastened to said upper end of said rear wall of said accommodating body.

5. The backpack as claimed in claim 1, further comprising:

a pair of breast and arm-retaining bands fastened respectively to said left and right sides of said rear wall of said accommodating body and having free ends that are interconnected removably so as to clamp a breast and two arms of an injured person between said rear wall of said accommodating body and said breast and arm-retaining bands; and a pair of waist-retaining bands fastened respectively to said left and right sides of said front wall and having free ends that are interconnected removably so as to clamp a waist of the injured person between said front wall of said accommodating body and said waist-retaining bands.

6. The backpack as claimed in claim 5, further comprising a pair of auxiliary retaining bands adapted to extend between two thighs of the injured person, each of said auxiliary retaining bands having a fixed end connected fixedly to said outer side surface of said front wall of said accommodating body and adapted to be disposed between two thighs of the injured person, and a movable end connected removably to an assembly of said waist-retaining bands.

7. The backpack as claimed in claim 1, further comprising a cover wall extending rearwardly from an upper end of said front wall of said accommodating body so as to cover said upper end opening of said accommodating space in said accommodating body.

8. The backpack as claimed in claim 7, wherein said cover wall of said accommodating body has an inner side surface that faces said accommodating space in said accommodating body and that is provided with two shin-retaining bands that are fastened to said cover wall and that are interconnected removably so as to clamp two shins of an injured person between said cover wall of said accommodating body and said shin-retaining bands.

9. The backpack as claimed in claim 1, wherein said accommodating body further has a plurality of loop members fastened to an assembly of said inner side surfaces of said bottom, front, rear, and cover walls, each of said sliding plates having a first side surface, a second side surface opposite to said first side surface, and a plurality of hooks attached fixedly to said first side surface, said hooks of said sliding plates extending respectively through said loop members of said accommodating body so as to retain said sliding plates on said accommodating body when said accommodating body is stretched.

10. The backpack as claimed in claim 9, wherein each of said sliding plates is rectangular and elongated, and has two tapered ends, said first side surface of each of said sliding plates being planar, said second side surface of each of said sliding plates having two curved ends.

11. The backpack as claimed in claim 1, further comprising a breast-retaining unit that includes elongated first and second retaining members which are fastened to said outer side surface of said rear wall of said accommodating body and which are interconnected removably so as to clamp a breast of an injured person between said rear wall of said accommodating body and said breast-retaining unit.

12. The backpack as claimed in claim 1, further comprising four U-shaped raising bands that are fastened respectively to said left and right sides of said front and rear walls of said accommodating body and that are pulled upwardly to raise said accommodating body from the ground.

* * * * *